US009120000B2

(12) United States Patent
Weston

(10) Patent No.: US 9,120,000 B2
(45) Date of Patent: Sep. 1, 2015

(54) CATCHING APPARATUS AND METHOD

(71) Applicant: Timothy Myles Weston, Oakville (CA)

(72) Inventor: Timothy Myles Weston, Oakville (CA)

(73) Assignee: Timothy Myles Weston, Oakville, Ontario (CA)

( * ) Notice: Subject to any disclaimer, the term of this patent is extended or adjusted under 35 U.S.C. 154(b) by 78 days.

(21) Appl. No.: 13/774,868

(22) Filed: Feb. 22, 2013

(65) Prior Publication Data

US 2014/0243118 A1 Aug. 28, 2014

(51) Int. Cl.

| | |
|---|---|
| ***A63B 63/00*** | (2006.01) |
| ***A63B 69/00*** | (2006.01) |
| ***A63B 71/02*** | (2006.01) |
| ***A63B 47/02*** | (2006.01) |

(52) U.S. Cl.

CPC ..... *A63B 63/004* (2013.01); *A63B 47/02* (2013.01); *A63B 63/00* (2013.01); *A63B 71/022* (2013.01); *A63B 2209/10* (2013.01); *A63B 2225/093* (2013.01)

(58) Field of Classification Search

CPC .. A63B 63/00; A63B 2063/002; A63B 63/04; A63B 69/00; A63B 71/00; A63B 71/02; A63B 71/022; A63B 2209/10; A63B 2225/93

USPC ..... 473/470, 471, 476, 478, 422, 446, 473; 273/348, 398, 400, 410; D21/705

See application file for complete search history.

(56) References Cited

U.S. PATENT DOCUMENTS

| | | | | | |
|---|---|---|---|---|---|
| 841,611 | A | * | 1/1907 | Alsop | 273/410 |
| 3,035,838 | A | * | 5/1962 | Johnston | 273/400 |
| 3,575,415 | A | * | 4/1971 | Fulp et al. | 273/400 |
| D222,978 | S | * | 2/1972 | Vinas | D21/705 |
| 3,822,883 | A | * | 7/1974 | De Vos | 273/400 |
| 3,918,711 | A | * | 11/1975 | Zak | 473/462 |
| 3,929,334 | A | * | 12/1975 | Magazzu | 473/478 |
| 4,068,846 | A | * | 1/1978 | Forrest | 473/439 |
| 4,863,166 | A | * | 9/1989 | Becera et al. | 473/454 |
| 5,037,095 | A | * | 8/1991 | Nedwick | 473/439 |
| 5,242,160 | A | * | 9/1993 | Girard et al. | 473/454 |
| D359,538 | S | * | 6/1995 | Hague | D21/705 |
| 5,472,212 | A | * | 12/1995 | Bercaw | 473/462 |
| D371,587 | S | * | 7/1996 | Braun | D21/705 |
| 5,569,094 | A | * | 10/1996 | Macaluso | 473/197 |
| 5,888,153 | A | * | 3/1999 | Masin | 473/446 |
| 6,659,893 | B1 | * | 12/2003 | Campbell et al. | 473/459 |
| 6,860,825 | B2 | * | 3/2005 | Clark | 473/478 |
| 6,889,982 | B1 | * | 5/2005 | Gove | 273/343 |
| 6,929,570 | B2 | * | 8/2005 | Forman, III | 473/462 |
| 7,056,241 | B1 | * | 6/2006 | Ishino | 473/459 |
| 7,614,968 | B1 | * | 11/2009 | Davies | 473/466 |
| 2003/0025272 | A1 | * | 2/2003 | Billig et al. | 273/400 |
| 2004/0072635 | A1 | * | 4/2004 | Clark | 473/478 |
| 2006/0079351 | A1 | * | 4/2006 | Brenneke | 473/439 |
| 2007/0191147 | A1 | * | 8/2007 | Guptill | 473/465 |
| 2010/0062880 | A1 | * | 3/2010 | Hayes | 473/422 |
| 2010/0081513 | A1 | * | 4/2010 | La Pointe | 473/197 |
| 2011/0092319 | A1 | * | 4/2011 | Gurgul et al. | 473/471 |

(Continued)

*Primary Examiner* — Raleigh W Chiu

(74) *Attorney, Agent, or Firm* — Philip C. Mendes de Costa; Bereskin & Parr LLP/S.E.N.C.R.L., s.r.l.

(57) ABSTRACT

A catching apparatus has a bent steel frame and a mesh work mounted to the frame. The catching apparatus has an upper portion that defines the target or gathering zone, and a lower portion that defines a pouch or sling into which objects caught in the upper portion collect. The apparatus has side openings permitting objects caught therein to be retrieved.

8 Claims, 6 Drawing Sheets

(56) References Cited

U.S. PATENT DOCUMENTS

2013/0012339 A1* 1/2013 Rockoff ..... 473/422
2014/0121040 A1* 5/2014 Cappello et al. ..... 473/432
2014/0243118 A1* 8/2014 Weston ..... 473/470

* cited by examiner

CATCHING APPARATUS AND METHOD

FIELD OF INVENTION

This application relates to apparatus for arresting and retaining sporting projectiles, and to methods of operation and use thereof.

BACKGROUND OF THE INVENTION

Targets may be placed in, for example, hockey nets, lacrosse nets, or frame or cross-bar without netting, or such like, the object being for players to practice their shooting, and thereby improve their accuracy, by shooting at the targets. Competitions for accurately hitting the targets are not uncommon, and often great fun.

Disposable targets have been used. However, a problem with disposable targets is, as their name suggests that they tend to be destroyed by use. Whether the target is disposable or not, another problem may be that the projectile, such as a tennis ball or hockey puck, may bounce off the target, and one may not be sure whether the target has been hit accurately or not—which may lead to unpleasant disputes as to scoring in sporting contests. Alternatively, in bouncing off the target, the projectile may rebound outside the larger net more generally, such as may tend not to facilitate the subsequent collection of the projectiles.

SUMMARY OF INVENTION

The following summary may introduce the reader to the more detailed discussion to follow. The summary is not intended to, and does not, limit or define the claims.

In an aspect of the invention there is an apparatus for arresting sporting projectiles. The apparatus has a peripheral frame, a gathering portion and a retaining portion. The gathering portion is mounted to the peripheral frame upwardly of the retaining portion. The retaining portion defines an accommodation for projectiles received by the gathering portion.

In a feature of that aspect of the invention, the peripheral frame includes an upper transverse member, a first side member, a second side member, and a lower transverse member. The upper transverse member is mounted cross-wise between the first and second side members at an upper region thereof. The lower transverse member is mounted cross-wise between the first and second side members at a lower region thereof. The gathering portion is mounted downwardly of the upper transverse member. The retaining portion is mounted downwardly of the lower transverse portion.

In another feature, the lower transverse member stands forwardly proud of the upper transverse member. In a further feature, the apparatus includes a flexible web mounted to the framework, the gathering portion being defined by a first portion of the flexible web. In another further feature, the retaining portion is defined by a second portion of the flexible web. In another feature, the apparatus includes a flexible web mounted to the framework, the flexible web defining a sling located downwardly of the lower transverse member. In still yet another feature, the apparatus includes a side entry to the retaining portion whereby objects may sometimes be retrieved therefrom. In a further feature, the lower transverse member has first and second ends terminating at the first and second side members. Each of the side members has a lower portion formed into an upwardly and forwardly bent hook. Each of the hooks terminates at the lower transverse member intermediate the first and second ends thereof, whereby first and second access openings are co-operatively defined by the hooks and the lower transverse member, the access opening permitting objects to be retrieved from the accommodation.

In another aspect of the invention there is a sports projectile trap. It has a rigid frame; and a flexible web member mounted to the frame. The flexible web member has an upper portion defining a catchment, and a lower portion defining a retaining pocket.

In a feature of that aspect of the invention, the flexible web member has an uppermost margin and a lowermost margin, the uppermost margin being higher than the lowermost margin, such that the catchment is at least partially exposed upwardly of the lowermost margin and downwardly of the uppermost margin. There is an intermediate portion, the intermediate portion extending lower than the lowermost margin and defining a sling between the uppermost margin and the lowermost margin, the retaining pocket being defined by the sling.

In another feature, the frame includes a transverse member to which the lowermost margin of the web member is mounted. In a further feature, the transverse member stands forwardly, whereby the lowermost margin of the web member has a lip positioned forwardly of the catchment, and upwardly of the sling. In still another feature, the sling has a side opening through which to retrieve projectiles from the retaining pocket. In another feature, the web member is made of an open mesh. In another feature the frame is made of steel. In a further feature the catchment includes a target indicator. In another feature the trap has mountings by which to secure the trap to an adjacent support structure.

In another feature the frame includes a transverse member to which the lowermost margin of the web member is mounted. The transverse member stands forwardly, whereby the lowermost margin of the web member has a lip positioned forwardly of the catchment, and upwardly of the sling. The sling has a side opening through which to retrieve projectiles from the retaining pocket. The web member is made of an open mesh. The frame is made of steel and the catchment includes a target indicator. In still another feature, there is a combination of the sports projectile trap and a sporting net to which the projectile trap is mounted.

BRIEF DESCRIPTION OF THE ILLUSTRATIONS

These and other features and aspects of the invention may be explained and understood with the aid of the accompanying illustrations, in which:

FIG. 1 is a perspective view of an apparatus according to an aspect of the present invention as deployed;

FIG. 2*a* is a perspective view of an arresting apparatus as seen in FIG. 1, viewed from the front and to one side;

FIG. 2*b* is a view of the arresting apparatus of FIG. 2*a*, with projectiles caught therein;

DETAILED DESCRIPTION

Figure 1:
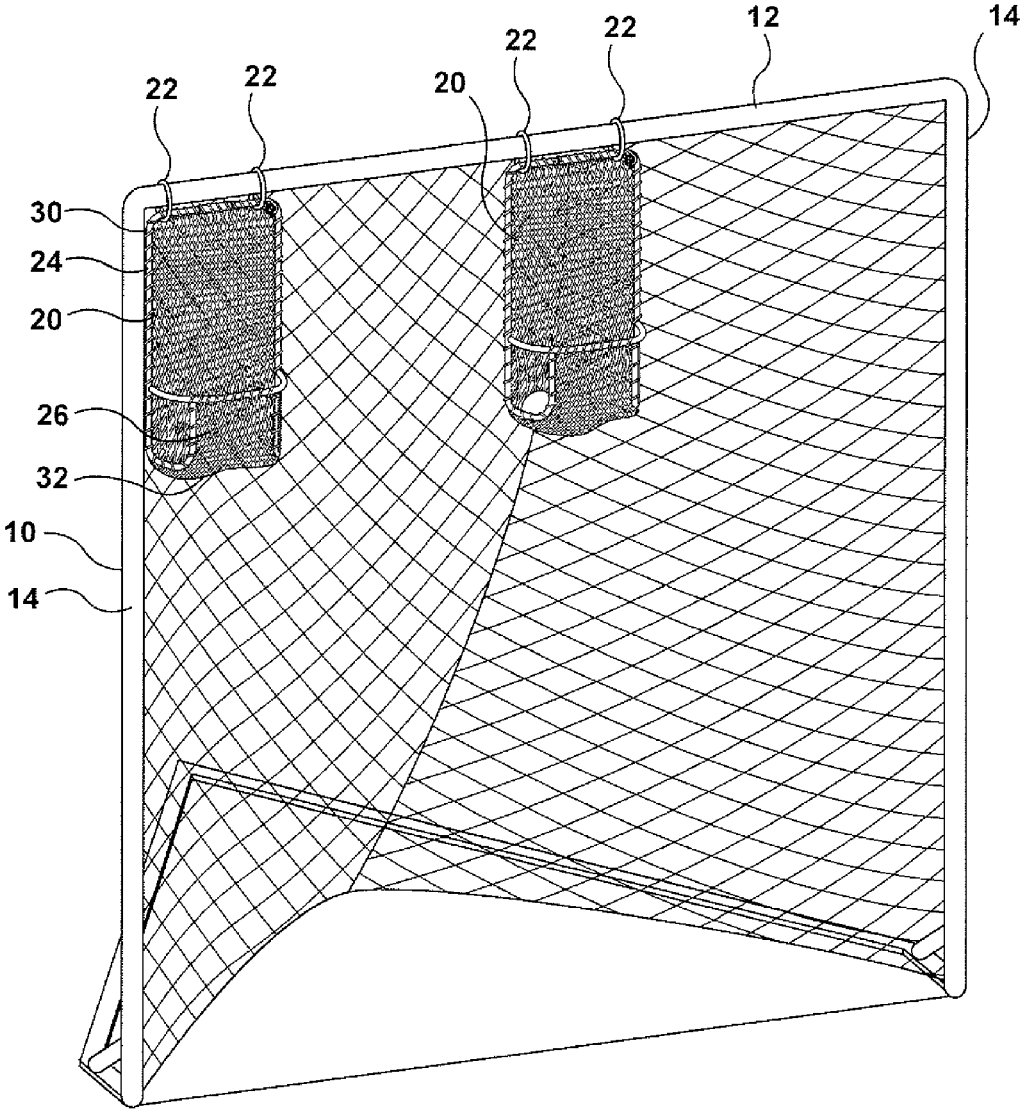

The description that follows, and the embodiments described therein, are provided by way of illustration of an example, or examples, of particular embodiments incorporating one or more of the principles, aspects and features of the present invention. These examples are provided for the purposes of explanation, and not of limitation, of those principles, aspects and features of the invention. In the description, like parts are marked throughout the specification and the drawings with the same respective reference numerals. The drawings may be taken as being to scale, or generally proportionate, unless indicated otherwise.

The scope of the invention herein is defined by the claims. The claims are not limited to any particular example or embodiment, and any claim may encompass processes or apparatuses other than the specific examples described below. Other than as indicated in the claims themselves, the claims are not limited to apparatus or processes having all of the features of any one apparatus or process described below, or to features common to multiple or all of the apparatus described below. It is possible that an apparatus, feature, or process described below is not an embodiment of any claim.

The terminology used in this specification is thought to be consistent with the customary and ordinary meanings of those terms as they would be understood by a person of ordinary skill in the art. The Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record, demonstrating how the terms are used and understood by persons of ordinary skill in the art, or by way of expert evidence of a person or persons of experience in the art.

In the discussion that follows, unless otherwise indicated, the geometric frame of reference for the description is that of a sporting net, or, more particularly, that of a goal keeper, where the term "forward" or "infront of" is in the direction facing toward the player shooting at the net, and rearward is in, or into, the net. Upward is measured from the goal-line toward the cross-bar of the net, and left and right, or transverse, or sideways, or cross-wise are terms that pertain to orientation predominantly across the net, for example toward one or another of the goal posts.

The terms "proud", "flush" and "shy" may be used herein, in the usualy mechanical engineering context. That is, objects are flush when they stand generally flat or level with one another. An object is "proud" when it stands out from its surroundings, and an object is "shy" when it is recessed relative to its surroundings. In mathematical terms, proud, flush, and shy are conceptually similar to greater than, equal to, and less than, respectively.

In this description, reference may be made to "sporting projectiles". The term "sporting projectile" is intended to encompass many different kinds of ball that may be thrown, kicked, batted, or shot by a hockey or lacrosse stick, struck by a cricket bat or a golf club, and so on. Depending on the size of the trap described below, the projectile may include a tennis ball, a ping-pong ball, a baseball or softball or cricket ball. It may include a non-spherical object, such as a North American football or a rugger ball. It may include a non-ball, such as a hockey puck or a frisbee, a badminton shuttlecock, or a hacky sack. The term is not intended to include such things as bullets from firearms, arrows from bows, bolts from cross-bows, javelins, spears, knives, sharp bladed objects or such other projectiles that might generally be thought of as weapons rather than sporting apparatus.

Although the apparatus discussed below may be described in the context of a projectile of the size of a tennis ball or hockey puck (i.e., 3" diameter×1" thickness), apparatus of appropriate size may be used for larger objects such as a soccer ball or football.

FIG. 1 shows a general arrangement of a sporting net 10, to which an apparatus 20 has been mounted. Sporting net 10 may be any of a number of kinds of net—such as a hockey net, a lacrosse net, a water-polo net, a soccer net, a football kicking practice net, a baseball catching practice net, a golfing practice net, and so on.

Apparatus 20 may be supported, or suspended, from the framework of net 10 by suspension fittings or mountings 22. Mountings 22 need not be mounted only to an upper cross-bar or transverse member 12 of net 10, but could also be mounted to a side post or side frame member 14 of the met structure more generally. Mountings 22 may be brackets or fasteners, and may in some instances be plastic tie-wraps, or hook-and-eye fabric strips (e.g., Velcro,™) or may be more substantial metal rings or chains or cables.

Apparatus 20 may be considered a catching apparatus, or a projectile arresting and retaining apparatus, or, more simply, a trap for sporting projectiles. Considering apparatus 20, it can be seen that there is a superior, or upper portion, 24, and an inferior, or lower, portion 26. Upper portion 24 may define a gathering portion, or receiving zone, or horn, or fan, or ear, or elephant ear, or shell, or region, or collector or catchment portion, however it may be termed, such as may be designated as catchment 30. The lower portion defines an accommodation, or receiving portion or retainer portion, which may be designated as retainer 32. In use, catchment 30 faces forwardly (i.e., toward persons throwing, shooting, or kicking objects at net 10), and objects that are gathered in catchment 30 collect in retainer 32. To the extent that gravity is relied upon to aid in directing objects from catchment 30 to retainer 32, retainer 32 may tend to be located lower than, or at a lower region of, catchment 30.

Considering the embodiment shown by way of example in FIGS. 2*a*, 2*b*, 3, 4, and 5, the trap or catching apparatus 20 may have a skeleton, or frame 34. Frame 34 may include an uppermost cross-member 36, first and second (or left and right hand) side members 38, 40 and a lower cross-member 42. Side members 38 and 40 may extend in a predominantly up-and-down or vertical orientation. Cross-members 36 and 42 may extend predominantly transversely or cross-wise between, and be joined to, side members 38 and 40. In some instances, when viewed from the front, the four members or portions may be said to co-operate to define a four-sided peripheral boundary. In the example shown, that boundary may appear as a rectangle when viewed from the front. That bounded periphery may define the periphery of catchment 30. It may, of course, be appreciated that the bounded periphery need not be four sided, but could be three or six, or eight sided (or any other number), or oval or round, or D-shaped, or fan shaped, or such other shape as may be appropriate. Members 36, 38, 40, and 42 may be made of a strong and durable material such as may be suitable for enduring repeated impact from objects directed toward apparatus 20 with frequently imperfect aim. Such material may be metal, and may be formed of a steel rod or wire bent to shape or in sections welded or otherwise fastened together, or partially bent and partially welded, as may be. In some embodiments aluminum may be used. In some instances hollow mild steel pipe may be used. The lateral spacing of side members 38, 40 and the up-and-down spacing of cross-members 36 and 42 is sufficient to admit the objects apparatus 20 is to catch in use. That is, the spacing for catching tennis balls or baseballs may be rather less than the spacing required for a soccer ball or football.

In the embodiment shown, cross-member 36, side member 38 and side member 40 may be made from a single continuous bent member, such as a bent rod or may be two opposite-handed left and right hand bent rods joined at a connector, as at 56. The lower ends or regions portions of side members 38 and 40 may extend downwardly past lower cross-member 42, as at 44, 46 respectively, and may be bent around and back upwardly such that their ends meet with cross-member 42 again. That is, lower cross-member 42 may have first and second ends 48, 50 connected, e.g., as by welding, to side members 38 and 40 at a lower region thereof distant from upper cross-member 36, and respective lower end portions 44 and 46 meet cross-member 42 at some location intermediate ends 48, 50. As may be noted, the curved around ends may co-operate with respective portions of cross-member 42 to define loops or apertures, or openings, 52, 54.

In some embodiments, such as the embodiment shown, lower cross-member 42 may stand in whole or in part forwardly proud of the rest of frame 34. In the example, cross-member 42 may be bent such that it is foremost in the middle, with its lateral end portions bent rearwardly to meet side members 38 and 40 respectively. As may be noted, in some embodiments, such as the embodiment shown, upper cross-member 36 and the major or upper portions of side members 38, 40 above ends 48, 50 may tend to be co-planar, and to define an inverted generally U-shaped member, with curved hooks at the ends. Cross-member 42 may then describe a forwardly proud out-of-plane member. In this configuration, the curved hooks of end regions 44 and 46 are also bent out-of-plane, and may stand in a different plane angled outwardly and forward. Openings 52, 54 may then face predominantly sideways, as opposed to forward or rearward.

Frame 34 provides the supporting, substantially rigid, skeleton for a collecting array or web member 60. Web member may be just that—a member that may be modeled as having resistance in tension, but no resistance to out-of-plane flexure. Web member 60 may be a continuous sheet or fabric or panel, and such panel or sheet may be made of a resilient or elastic material such as Spandex (™) or other elastic synthetic fabric. In some embodiments web member 60 may be made of canvas. Alternatively, web member 60 may be a woven or other web or mesh, such as may be made of Nylon (™) or other plastic, leather, wire, and so on, of a size and spacing and strength commensurate with the size of object being received and the expected impact to be endured. Web member 60 may be stretched across from 34. Such stretching or suspending may be gentle as the function of web member 60, and of apparatus 20 more broadly, is to arrest an object with significant kinetic energy. To that end, a flexing web member of woven filaments may tend to deflect, stretch, and then act as a motion damper, or trap. As web 60 deflects and stretches, the object being caught may tend to be reacted and given a component of motion generally toward the center of web 60 on a left-to-right basis, and also a downwardly component of motion toward retainer 32. A target, 58, may be added to web member 60. An example of such a target is a bull's-eye or X pattern painted on, sewn to, or dyed into, web member 60.

Figure 2A:
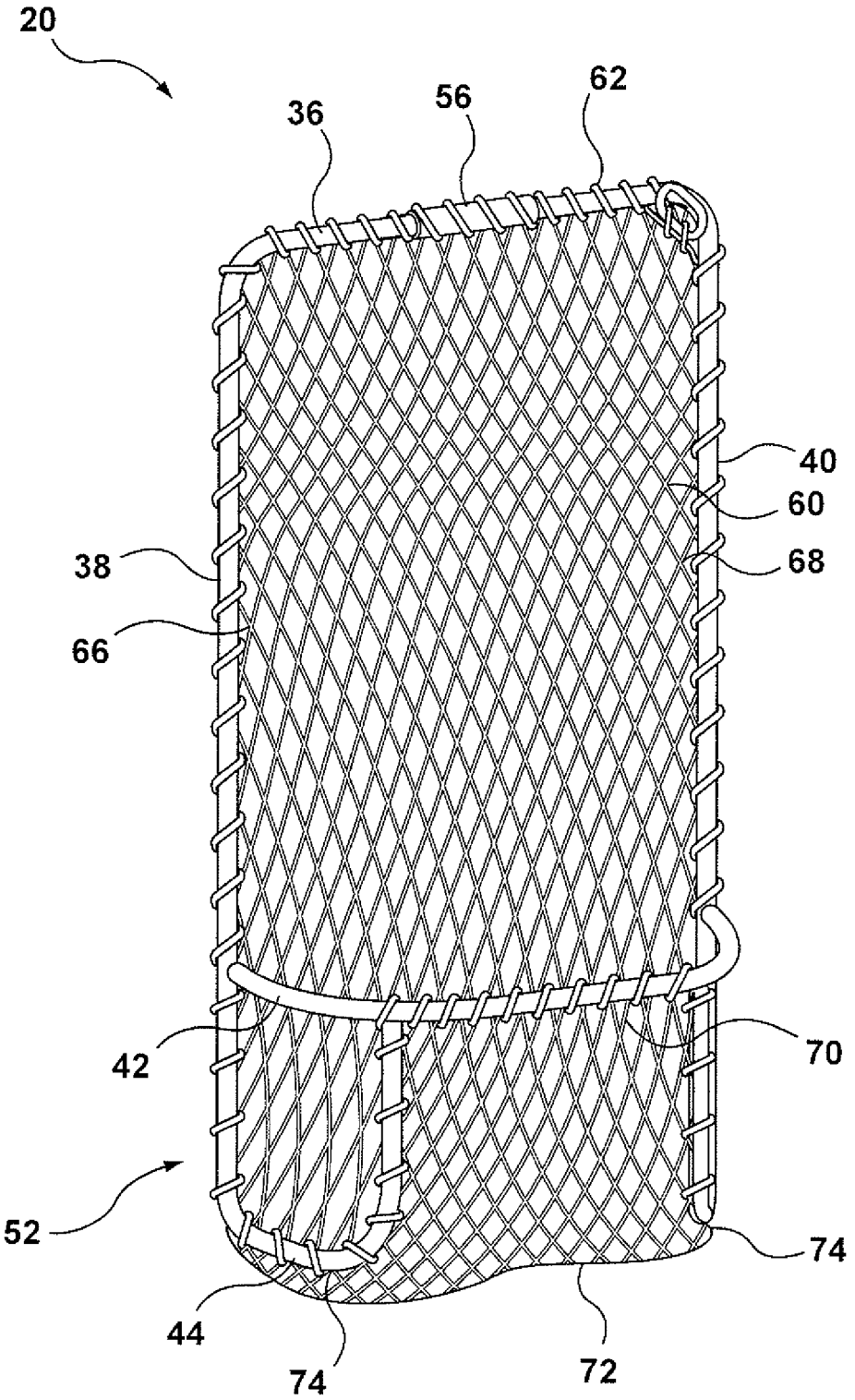
Figure 2B:
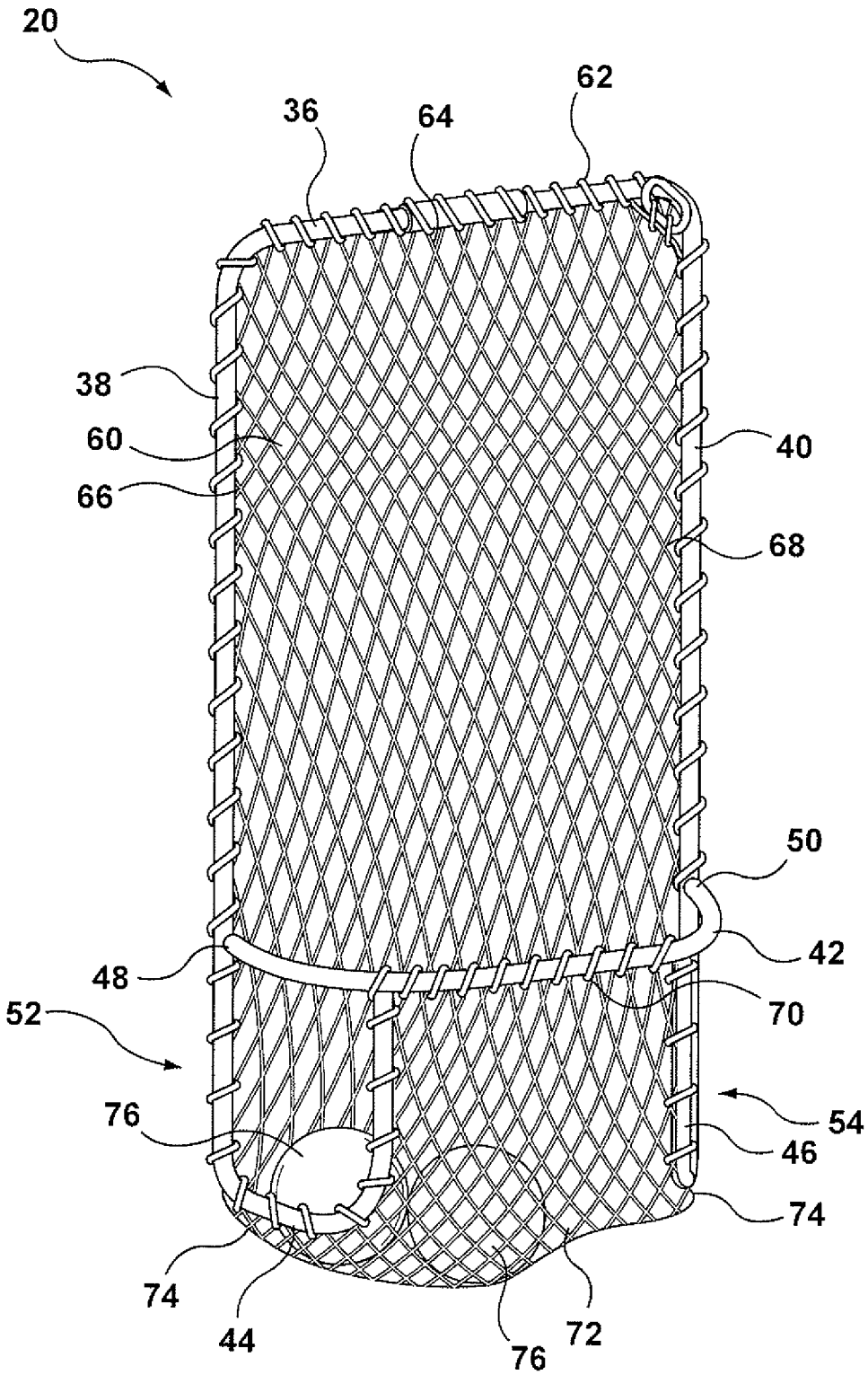
Figure 5:
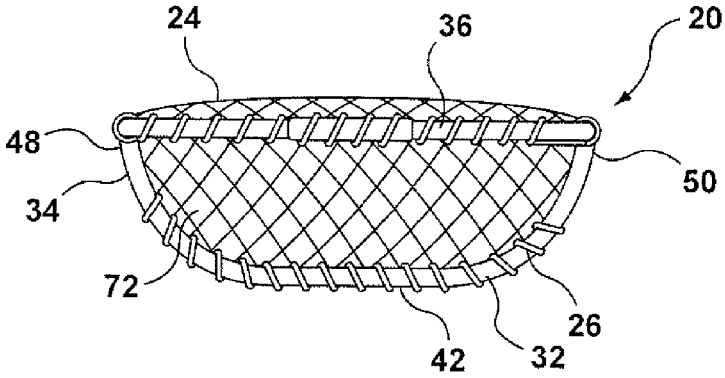
FIG. 5 is a top view of the projectile arresting apparatus of FIG. 2*a;*
Figure 4:
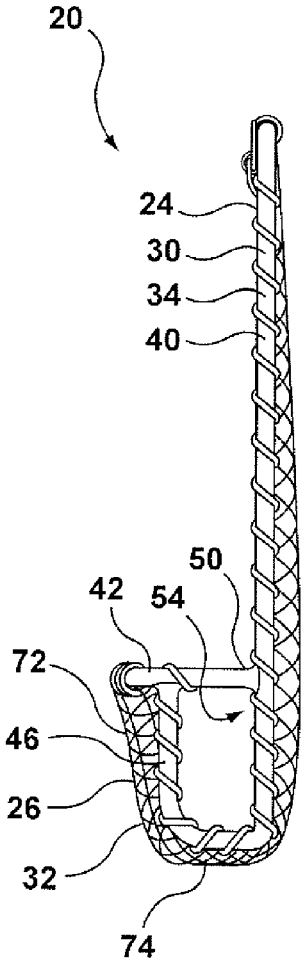
FIG. 4 is a side view of the projectile arresting apparatus of FIG. 2*a;*
Figure 3:
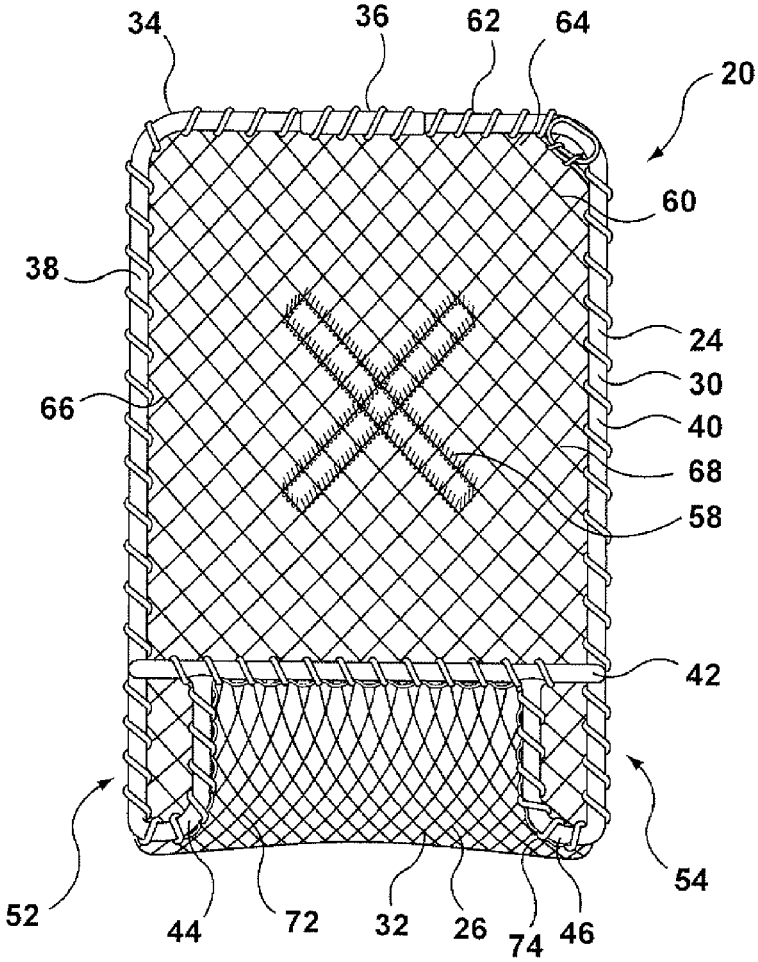
FIG. 3 is a front view of the projectile arresting apparatus of FIG. 2*a;*

Retainer 32 may have the form of a cup, or pouch, or pocket, and may be made separately from web member 60. Retainer 32 may be made of a rigid material, such as sheet metal, or an aluminum trough, or a plastic trough or pocket, or it may be made of a flexible material, whether as a continuous sheet of woven strands, or as a web or mesh or flexible material. Alternatively, as in the embodiment of FIGS. 2*a*, 2*b*, 3, 4, and 5, retainer 32 may be formed from a continuation of web 60. That is, web 60 may have an upper portion or margin 64 mounted to upper cross-member 36, and may have side portions mounted to side members 38, 40, in each case as by sewing, strapping or bonding, as at 62, but may also have a lower most and foremost margin 70 that is similarly mounted to cross-member 42, and that hangs or extends rearwardly and downwardly thereof, either by being secured to the hook portions or end regions 44, 46, as at 74, or by hanging unsupported (in which case the lower edge may be reinforced by an edge member or seam). The effect is that the lower region of web 60 then forms a pouch or pocket or sling 72. That hangs downwardly to form a seat or depression behind the forward upper lip thereof defined by lower cross-member 42. In proportion, the height of catchment 30 is substantially greater than the depth of the pocket defined by sling 72, the height of the pocket being in the range of ⅕ to ⅓ of the total overall height of apparatus 20 more generally. When an object is received in catchment 30, is moves downward into retainer 32, and its own weight causes the web of sling 72 to deflect or bulge out as shown in FIG. 2*b*, such that balls or other objects may tend to find a seat generally toward the middle of sling 72. After the activity is over, a person may reach through opening 52 or 54 and retrieve the ball or puck, or other object, as may be.

It may be appreciated that apparatus 20 may not necessarily catch every object directed toward it, though it may catch many of them. That is, in one embodiment for catching round balls it may catch about 90% of them. In some embodiments it may not be suitable for catching non-spherical objects, such as hockey pucks. Further, the size and proportions of apparatus 20 may change depending on the object that it is intended to catch. An embodiment suited to catch a baseball may have a different size or proportion from an apparatus for catching a hockey puck or a football. Further, for some objects the proportion of the forwardness of member 42 from side members 38, 40 may vary. In the embodiment shown it may be ⅛ to ⅓ of the overall height of apparatus 20. Further still, the tension in web 60 may be relatively tight or loose depending on the object to be caught, and, for object that might otherwise be prone to bounce off, web 60 may have a modest sag, even like a sack or bag or sock.

Although the embodiments described above have been considered in the context of mounting in a net, this need not necessarily be so. Trap apparatus 20 may be mounted from a free-standing frame, a tree-limb, or other support apparatus, and may be mounted within a batting cage, or in front of a baseball or softball back-stop fence, for example. For some, the ball retaining feature may tend to make use of the target more fun, and give gratification that they have "hit their mark". Apparatus 20 provides a visual reference, or mark, whether the object is caught or not. The apparatus may also tend to retain the balls, and, by collecting them in that way obviate the need to gather them together. Collecting and retaining the balls may tend to speed up practice (by reducing collection time) and may in some instances be safer. When suspended from a cross-bar or other such member, a bottom drogue or tether may also be used, such as may be tied to a lower or ground mount, such as a baseball base pad, to discourage excessive swinging.

Figure 6:
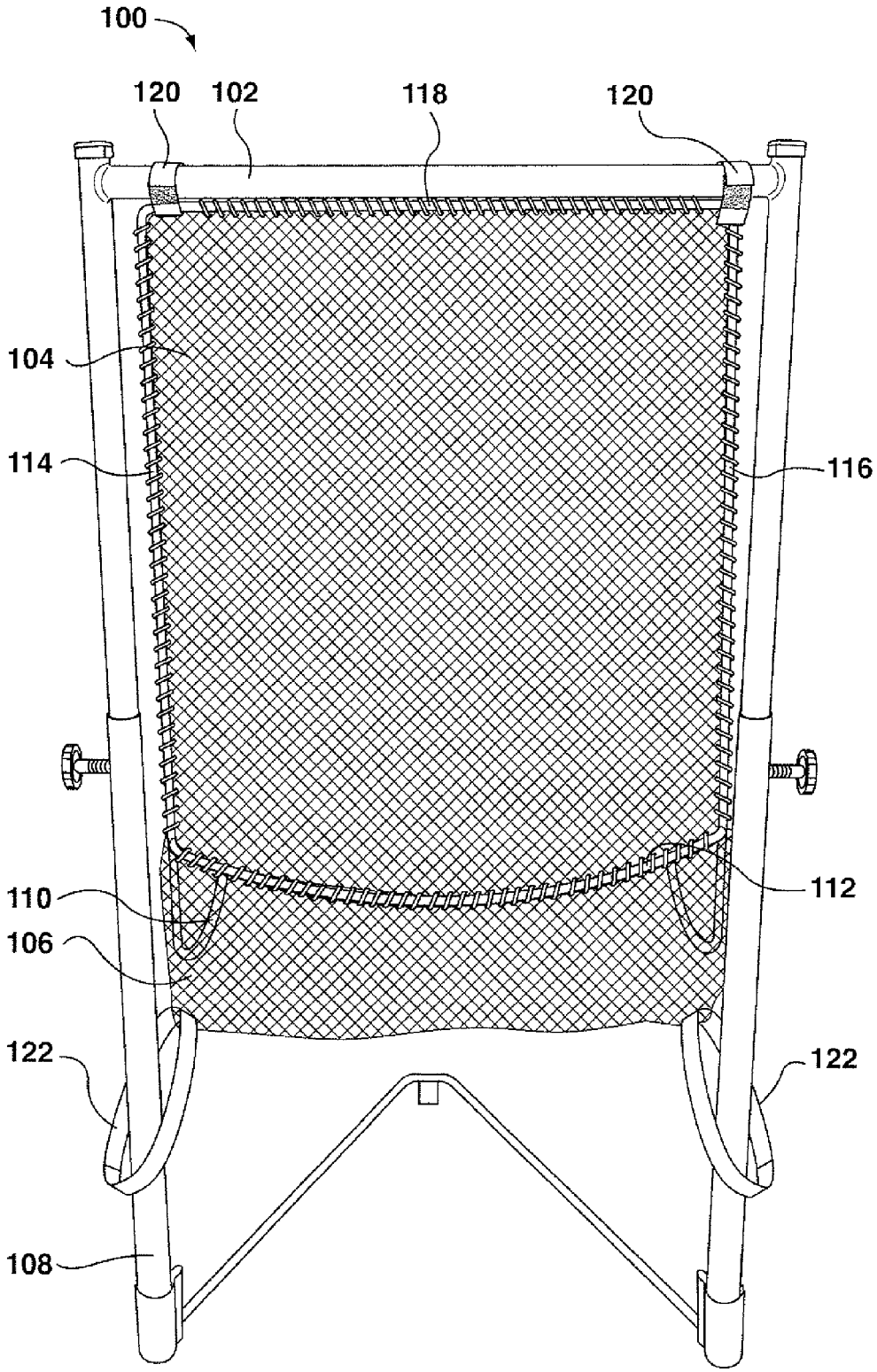
FIG. 6 shows a front view of an alternate embodiment of catching apparatus to that of FIG. 1.

For example, in the embodiment of FIG. 6 there is a catching apparatus indicated generally as 100. It is mounted to a free-standing frame 102, which may have tubular members and bracing 108. Apparatus 100 may have an upper catchment portion 104, generally as before, and a lower retainer or pocket or pouch, or sling 106 as before. Catchment portion 104 and sling 106 may be made of a flexible mesh webbing. Apparatus 100 may have a frame, such as may be made from rod or wire as described above. That frame may include predominantly up-and-down or vertically oriented right and left hand side members 114 and 116, an upper cross-member 118 (tethered to frame 102 by mountings 120 which may be Velcro (™) fabric fastener straps). The frame may also include a lower transverse member, or cross-member, 112, which may be formed to bow forwardly outwardly out of the vertical plane of members 114, 116 and 118. Additionally, from the lower portions of members 114 and 116 below cross-member 112 (the height difference defining the depth of the retaining pocket or pouch 106) the frame may include a bottom member, or spreader 110, which may have the shape of a rectangular or trapezoidal or rearwardly-extending U-shaped frame member such as to spread the bottom of the webbing rearwardly. Additionally, too, apparatus 100 may be loosely tethered free-standing frame 102 by additional lower tethers, or fittings 122, which may be attached at the lower front corners of pouch 106, to discourage excessive swinging of apparatus 100.

Figure 7:
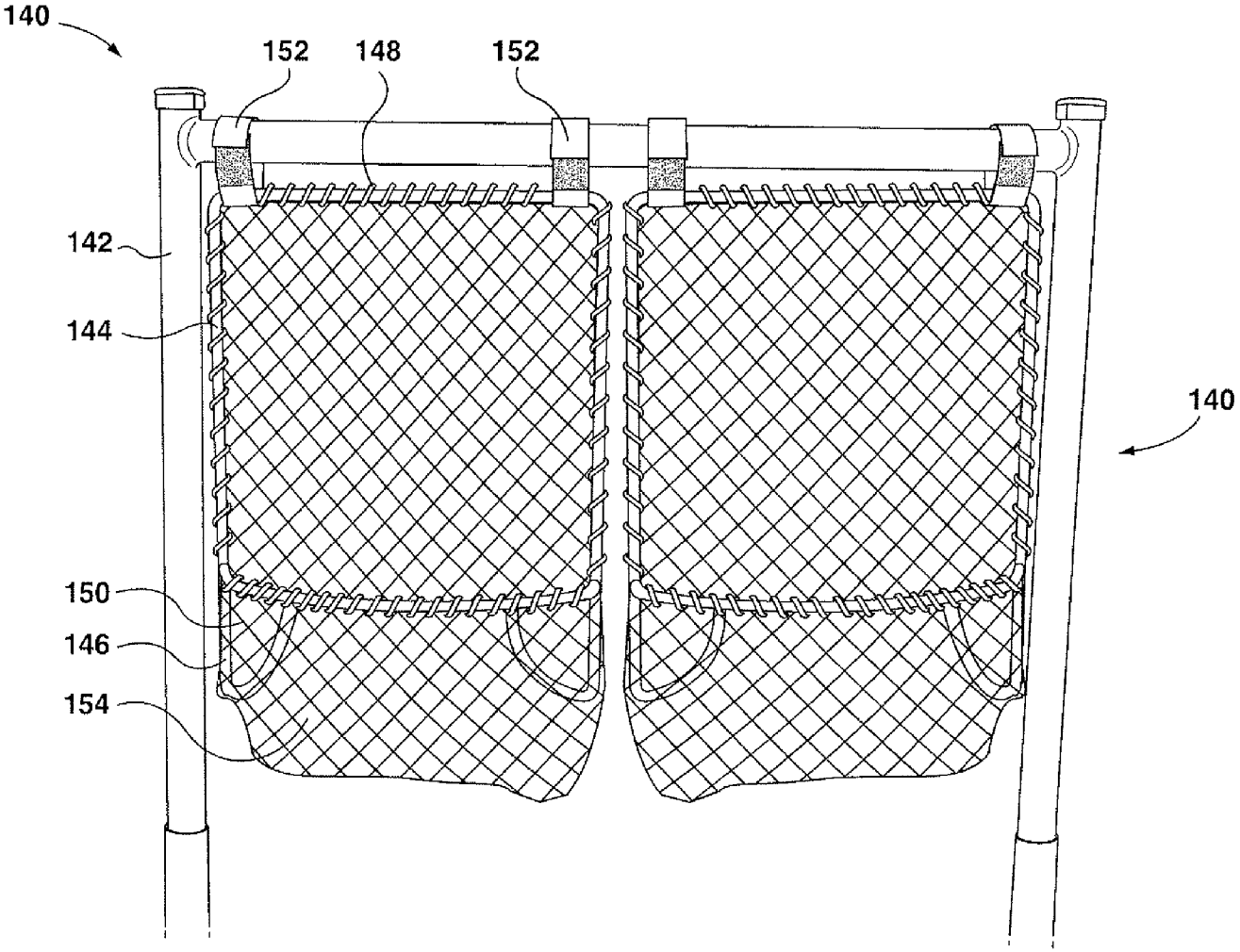
FIG. 7 shows a front view of a further alternate embodiment of catching apparatus to that of FIG. 1.

In the embodiment of FIG. 7, there are two apparatus 140, differing only in the left and right handedness of their target markings. In this embodiment, apparatus 140 are mounted to free-standing frame 142 by fitting 152, such as may be Velcro (™) straps. The upper catchment portion is identified as 144, and the lower pouch portion is identified as 146. Apparatus 140 is generally similar to apparatus 20, except that the openings in the framework 148 at the side are covered over by mesh, as indicated at 150. Further, the bottom pouch or pocket of the mesh-word 154 extends downwardly beyond the lower portion of the bent-forward lower hook-ends of the die members of framework 148.

What has been described above has been intended illustrative and non-limiting and it will be understood by persons skilled in the art that other variances and modifications may be made without departing from the scope of the disclosure as defined in the claims appended hereto. Various embodiments of the invention have been described in detail. Since changes in and or additions to the above-described best mode may be made without departing from the nature, spirit or scope of the invention, the invention is not to be limited to those details but only by the appended claims.

I claim:

1. An apparatus for arresting sporting projectiles, said apparatus comprising a peripheral frame, a gathering portion and a retaining portion, said gathering portion being mounted to said peripheral frame upwardly of said retaining portion, said retaining portion defining an accommodation for projectiles received by said gathering portion, wherein an upper transverse member, a first side member, a second side member, and a lower transverse member;

said upper transverse member being mounted cross-wise between said first and second side members at an upper region thereof;

said lower transverse member being mounted cross-wise between said first and second side members at a lower region thereof;

said gathering portion being mounted downwardly of said upper transverse member; and said retaining portion being mounted downwardly of said lower transverse portion;

said lower transverse member has first and second ends terminating at said first and second side members;

each of said side members has a lower portion formed into an upwardly and forwardly bent hook;

each of said hooks terminating at said lower transverse member intermediate said first and second ends thereof, whereby first and second access openings are co-operatively defined by said hooks and said lower transverse member, said access opening permitting objects to be retrieved from said accommodation.

2. The apparatus of claim 1 wherein said lower transverse member stands forwardly proud of said upper transverse member.

3. The apparatus of claim 2 wherein said apparatus includes a flexible web mounted to said framework, said gathering portion being defined by a first portion of said flexible web.

4. The apparatus of claim 3 wherein said retaining portion is defined by a second portion of said flexible web.

5. The apparatus of claim 1 wherein said apparatus includes a flexible web mounted to said framework, said gathering portion being defined by a first portion of said flexible web.

6. The apparatus of claim 5 wherein said retaining portion is defined by a second portion of said flexible web.

7. The apparatus of claim 1 wherein said apparatus includes a flexible web mounted to said framework, said flexible web defining a sling located downwardly of said lower transverse member.

8. The apparatus of claim 1 wherein said apparatus includes a side entry to said retaining portion whereby objects may be retrieved therefrom.

* * * * *